US007631871B2

(12) United States Patent
Bozeman

(10) Patent No.: US 7,631,871 B2
(45) Date of Patent: Dec. 15, 2009

(54) LOTTERY GAME BASED ON COMBINING PLAYER SELECTIONS WITH LOTTERY DRAWS TO SELECT OBJECTS FROM A THIRD SET OF INDICIA

(75) Inventor: Alan Kyle Bozeman, Alpharetta, GA (US)

(73) Assignee: Scientific Games International, Inc., Newark, DE (US)

( * ) Notice: Subject to any disclaimer, the term of this patent is extended or adjusted under 35 U.S.C. 154(b) by 271 days.

(21) Appl. No.: 11/209,180

(22) Filed: Aug. 22, 2005

(65) Prior Publication Data

US 2006/0076734 A1 Apr. 13, 2006

Related U.S. Application Data

(60) Provisional application No. 60/617,824, filed on Oct. 11, 2004.

(51) Int. Cl.
*A63F 3/06* (2006.01)

(52) U.S. Cl. ..... 273/269; 273/139

(58) Field of Classification Search ..... 463/17, 463/25, 40; 235/486; 273/139
See application file for complete search history.

(56) References Cited

U.S. PATENT DOCUMENTS

| | | | |
|---|---|---|---|
| 1,527,929 | A | 2/1925 | Simons |
| 3,089,123 | A | 5/1963 | Hennis et al. |
| 3,245,697 | A | 4/1966 | BNugent |
| 3,699,311 | A | 10/1972 | Dunbar |
| 3,736,368 | A | 5/1973 | Vogelman et al. |
| 3,826,499 | A | 7/1974 | Lenkoff |
| 3,868,057 | A | 2/1975 | Chavez |
| 3,876,865 | A | 4/1975 | Bliss |
| 3,902,253 | A | 9/1975 | Sabuzawa et al. |

(Continued)

FOREIGN PATENT DOCUMENTS

| | | |
|---|---|---|
| AU | B-18428/92 | 12/1992 |

(Continued)

OTHER PUBLICATIONS

'Beginner's Guide-How To Bet', (www.plimico.com/How+to+wager/beginnersguide/), (Internet Article), 3 Pgs.

(Continued)

*Primary Examiner*—Peter DungBa Vo
*Assistant Examiner*—Masud Ahmed
(74) *Attorney, Agent, or Firm*—Dority & Manning, P.A.

(57) ABSTRACT

A system and method for implementing a lottery game that correlates a first and second sequence of indicia, such as by pairing each term in the first sequence with the term in the second sequence in the same relative position. The correlation is subsequently mapped to a third set of indicia by the game process. For example, the game process may be a Latin square for which each term in the first sequence is identified with a row and each term in the second sequence is identified with a column (or vice versa) and the entries of the square are elements of a third set. Prizes are determined based on the properties of the third set of indicia, such as the number of occurrences of a particular symbol. The entertainment value lies in the various correlating and mapping.

26 Claims, 9 Drawing Sheets

U.S. PATENT DOCUMENTS

| | | | |
|---|---|---|---|
| 3,918,174 | A | 11/1975 | Miller et al. |
| 3,922,529 | A | 11/1975 | Orloff |
| 3,934,120 | A | 1/1976 | Maymarev |
| 4,017,834 | A | 4/1977 | Cuttill et al. |
| 4,095,824 | A | 6/1978 | Bachman |
| 4,105,156 | A | 8/1978 | Dethloff |
| 4,176,406 | A | 11/1979 | Matkan |
| 4,191,376 | A | 3/1980 | Goldman et al. |
| 4,194,296 | A | 3/1980 | Pagnozzi et al. |
| 4,195,772 | A | 4/1980 | Nishimura |
| 4,206,920 | A | 6/1980 | Weatherford et al. |
| 4,241,942 | A | 12/1980 | Bachman |
| 4,243,216 | A | 1/1981 | Mazumder |
| 4,273,362 | A | 6/1981 | Carrier et al. |
| 4,309,452 | A | 1/1982 | Sachs |
| 4,313,087 | A | 1/1982 | Weitzen et al. |
| 4,355,300 | A | 10/1982 | Weber |
| 4,375,666 | A | 3/1983 | Buck et al. |
| 4,398,708 | A | 8/1983 | Goldman et al. |
| 4,407,443 | A | 10/1983 | McCorkle |
| 4,451,759 | A | 5/1984 | Heynisch |
| 4,455,039 | A | 6/1984 | Weitzen et al. |
| 4,457,430 | A | 7/1984 | Darling et al. |
| 4,464,423 | A | 8/1984 | LaBianca et al. |
| 4,466,614 | A | 8/1984 | Bachman et al. |
| 4,488,646 | A | 12/1984 | McCorkle |
| 4,491,319 | A | 1/1985 | Nelson |
| 4,494,197 | A | 1/1985 | Troy et al. |
| 4,536,218 | A | 8/1985 | Ganho |
| 4,544,184 | A | 10/1985 | Freund et al. |
| 4,579,371 | A | 4/1986 | Long et al. |
| 4,591,189 | A | 5/1986 | Holmen et al. |
| 4,634,149 | A | 1/1987 | Donovan |
| 4,665,502 | A | 5/1987 | Kreisner |
| 4,669,729 | A | 6/1987 | Solitt et al. |
| 4,689,742 | A | 8/1987 | Troy et al. |
| 4,726,608 | A | 2/1988 | Walton |
| 4,736,109 | A | 4/1988 | Dvorzsak |
| 4,740,016 | A | 4/1988 | Konecny et al. |
| 4,760,247 | A | 7/1988 | Keane et al. |
| 4,763,927 | A | 8/1988 | Schneider |
| 4,775,155 | A | 10/1988 | Lees |
| 4,792,667 | A | 12/1988 | Chen |
| 4,805,907 | A | 2/1989 | Hagiwara |
| 4,817,951 | A | 4/1989 | Crouch et al. |
| 4,835,624 | A | 5/1989 | Black et al. |
| 4,836,546 | A | 6/1989 | Dire et al. |
| 4,836,553 | A | 6/1989 | Suttle et al. |
| 4,837,728 | A | 6/1989 | Barrie et al. |
| 4,856,787 | A | 8/1989 | Itkis |
| 4,861,041 | A | 8/1989 | Jones et al. |
| 4,870,260 | A | 9/1989 | Niepolomski et al. |
| 4,880,964 | A | 11/1989 | Donahue |
| 4,888,244 | A | 12/1989 | Masubuchi et al. |
| 4,922,522 | A | 5/1990 | Scanlon |
| 4,943,090 | A | 7/1990 | Fienberg |
| 4,960,611 | A | 10/1990 | Fujisawa et al. |
| 4,961,578 | A | 10/1990 | Chateau |
| 4,964,642 | A | 10/1990 | Kamille |
| 4,996,705 | A | 2/1991 | Entenmann et al. |
| 4,998,010 | A | 3/1991 | Chandler et al. |
| 4,998,199 | A | 3/1991 | Tashiro et al. |
| 5,032,708 | A | 7/1991 | Comerford et al. |
| 5,037,099 | A | 8/1991 | Burtch |
| 5,046,737 | A | 9/1991 | Fienberg |
| 5,074,566 | A | 12/1991 | Desbiens |
| 5,083,815 | A | 1/1992 | Scrymgeour et al. |
| 5,092,598 | A | 3/1992 | Kamille |
| 5,094,458 | A | 3/1992 | Kamille |
| 5,100,139 | A | 3/1992 | Di Bella |
| 5,109,153 | A | 4/1992 | Johnson et al. |
| 5,112,050 | A | 5/1992 | Koza et al. |
| 5,116,049 | A | 5/1992 | Sludikoff et al. |
| 5,118,109 | A | 6/1992 | Gumina |
| 5,119,295 | A | 6/1992 | Kapur |
| 5,158,293 | A | 10/1992 | Mullins |
| 5,165,967 | A | 11/1992 | Theno et al. |
| 5,186,463 | A | 2/1993 | Marin et al. |
| 5,189,292 | A | 2/1993 | Batterman et al. |
| 5,193,815 | A | 3/1993 | Pollard |
| 5,193,854 | A | 3/1993 | Borowski, Jr. et al. |
| 5,228,692 | A | 7/1993 | Carrick et al. |
| 5,232,221 | A | 8/1993 | Sludikoff et al. |
| 5,234,798 | A | 8/1993 | Heninger et al. |
| 5,249,801 | A | 10/1993 | Jarvis |
| 5,259,616 | A | 11/1993 | Bergmann |
| 5,273,281 | A | 12/1993 | Lovell |
| 5,276,980 | A | 1/1994 | Carter et al. |
| 5,282,620 | A | 2/1994 | Keesee |
| 5,308,992 | A | 5/1994 | Crane et al. |
| 5,317,135 | A | 5/1994 | Finocchio |
| 5,326,104 | A | 7/1994 | Pease et al. |
| 5,332,219 | A | 7/1994 | Marnell, II et al. |
| 5,342,047 | A | 8/1994 | Hiedel et al. |
| 5,342,049 | A | 8/1994 | Wichinsky et al. |
| 5,344,144 | A | 9/1994 | Canon |
| 5,346,258 | A | 9/1994 | Behn et al. |
| 5,380,007 | A | 1/1995 | Travis et al. |
| 5,393,057 | A | 2/1995 | Marnell, II et al. |
| 5,401,024 | A | 3/1995 | Simunek |
| 5,403,039 | A | 4/1995 | Borowski, Jr. et al. |
| 5,407,199 | A | 4/1995 | Gumina |
| 5,420,406 | A | 5/1995 | Izawa et al. |
| 5,432,005 | A | 7/1995 | Tanigami et al. |
| 5,451,052 | A | 9/1995 | Behm et al. |
| 5,456,465 | A | 10/1995 | Durham |
| 5,456,602 | A | 10/1995 | Sakuma |
| 5,471,040 | A | 11/1995 | May |
| 5,475,205 | A | 12/1995 | Behm et al. |
| 5,486,005 | A | 1/1996 | Neal |
| 5,513,846 | A | 5/1996 | Niederlien et al. |
| 5,528,154 | A | 6/1996 | Leichner et al. |
| 5,536,016 | A | 7/1996 | Thompson |
| 5,540,442 | A | 7/1996 | Orselli et al. |
| 5,548,110 | A | 8/1996 | Storch et al. |
| 5,550,746 | A | 8/1996 | Jacobs |
| 5,560,610 | A | 10/1996 | Behm et al. |
| 5,564,700 | A | 10/1996 | Celona |
| 5,564,977 | A | 10/1996 | Algie |
| 5,591,956 | A | 1/1997 | Longacre, Jr. et al. |
| 5,599,046 | A | 2/1997 | Behm et al. |
| 5,602,381 | A | 2/1997 | Hoshino et al. |
| 5,621,200 | A | 4/1997 | Irwin et al. |
| 5,628,684 | A | 5/1997 | Bouedec |
| 5,630,753 | A | 5/1997 | Fuchs |
| 5,651,735 | A | 7/1997 | Baba |
| 5,655,961 | A | 8/1997 | Acres et al. |
| 5,667,250 | A | 9/1997 | Behm et al. |
| 5,682,819 | A | 11/1997 | Beatty |
| 5,690,366 | A | 11/1997 | Luciano |
| 5,704,647 | A | 1/1998 | Desbiens |
| 5,722,891 | A | 3/1998 | Inoue |
| 5,726,898 | A | 3/1998 | Jacobs |
| 5,732,948 | A | 3/1998 | Yoseloff |
| 5,741,183 | A | 4/1998 | Acres et al. |
| 5,743,800 | A | 4/1998 | Huard et al. |
| 5,752,882 | A | 5/1998 | Acres et al. |
| 5,756,220 | A | 5/1998 | Hoshino et al. |
| 5,768,142 | A | 6/1998 | Jacobs |
| 5,769,458 | A | 6/1998 | Carides et al. |
| 5,770,533 | A | 6/1998 | Franchi |
| 5,772,509 | A | 6/1998 | Weiss |
| 5,772,510 | A * | 6/1998 | Roberts ..... 463/17 |
| 5,772,511 | A | 6/1998 | Smeltzer |

| | | | | |
|---|---|---|---|---|
| RE35,864 | E | 7/1998 | Weingardt | |
| 5,779,840 | A | 7/1998 | Boris | |
| 5,788,237 | A * | 8/1998 | Fults et al. | 273/269 |
| 5,789,459 | A | 8/1998 | Inagaki et al. | |
| 5,791,990 | A | 8/1998 | Schroeder et al. | |
| 5,797,794 | A | 8/1998 | Angell | |
| 5,803,504 | A | 9/1998 | Deshiens et al. | |
| 5,816,920 | A | 10/1998 | Hanai | |
| 5,818,019 | A | 10/1998 | Irwin, Jr. et al. | |
| 5,820,459 | A | 10/1998 | Acres et al. | |
| 5,823,874 | A | 10/1998 | Adams | |
| 5,830,063 | A | 11/1998 | Byrne | |
| 5,830,066 | A | 11/1998 | Goden et al. | |
| 5,830,067 | A | 11/1998 | Graves et al. | |
| 5,833,537 | A | 11/1998 | Barrie | |
| 5,835,576 | A | 11/1998 | Katz et al. | |
| 5,836,086 | A | 11/1998 | Elder | |
| 5,836,817 | A | 11/1998 | Acres et al. | |
| 5,848,932 | A | 12/1998 | Adams | |
| 5,863,075 | A | 1/1999 | Rich et al. | |
| 5,871,398 | A | 2/1999 | Schneier et al. | |
| 5,876,284 | A | 3/1999 | Acres et al. | |
| 5,882,261 | A | 3/1999 | Adams | |
| 5,883,537 | A | 3/1999 | Luoni et al. | |
| 5,885,158 | A | 3/1999 | Torango et al. | |
| 5,887,906 | A | 3/1999 | Sultan | |
| 5,903,340 | A | 5/1999 | Lawady et al. | |
| 5,911,418 | A | 6/1999 | Adams | |
| 5,915,588 | A | 6/1999 | Stoken et al. | |
| 5,934,671 | A | 8/1999 | Harrison | |
| 5,970,143 | A | 10/1999 | Shneier et al. | |
| 5,979,894 | A | 11/1999 | Alexoff | |
| 5,996,997 | A | 12/1999 | Kamille | |
| 5,997,044 | A | 12/1999 | Behm et al. | |
| 6,003,307 | A | 12/1999 | Naber et al. | |
| 6,004,207 | A | 12/1999 | Wilson, Jr. et al. | |
| 6,007,162 | A | 12/1999 | Hinz et al. | |
| 6,012,982 | A | 1/2000 | Piechowiak et al. | |
| 6,014,032 | A | 1/2000 | Maddix et al. | |
| 6,017,032 | A | 1/2000 | Grippo et al. | |
| 6,024,641 | A | 2/2000 | Sarno | |
| 6,053,405 | A | 4/2000 | Irwin, Jr. et al. | |
| 6,077,162 | A | 6/2000 | Weiss | |
| 6,080,062 | A | 6/2000 | Olson | |
| 6,086,477 | A | 7/2000 | Walker et al. | |
| 6,089,978 | A | 7/2000 | Adams | |
| 6,099,407 | A | 8/2000 | Parker, Jr. et al. | |
| 6,102,400 | A | 8/2000 | Scott et al. | |
| 6,107,913 | A | 8/2000 | Gatto et al. | |
| 6,119,364 | A | 9/2000 | Elder | |
| 6,125,368 | A | 9/2000 | Bridge et al. | |
| 6,142,872 | A | 11/2000 | Walker et al. | |
| 6,146,272 | A | 11/2000 | Walker et al. | |
| 6,149,521 | A | 11/2000 | Sanduski | |
| 6,155,491 | A | 12/2000 | Dueker et al. | |
| 6,168,521 | B1 | 1/2001 | Luciano et al. | |
| 6,168,522 | B1 | 1/2001 | Walker et al. | |
| 6,179,710 | B1 | 1/2001 | Sawyer et al. | |
| 6,203,430 | B1 | 3/2001 | Walker et al. | |
| 6,206,373 | B1 | 3/2001 | Garrod | |
| 6,210,275 | B1 | 4/2001 | Olsen | |
| 6,217,448 | B1 | 4/2001 | Olsen | |
| 6,220,961 | B1 | 4/2001 | Keane et al. | |
| 6,224,055 | B1 | 5/2001 | Walker et al. | |
| 6,227,969 | B1 | 5/2001 | Yoseloff | |
| 6,234,899 | B1 * | 5/2001 | Nulph | 463/25 |
| 6,237,913 | B1 * | 5/2001 | Kamille | 273/139 |
| 6,238,288 | B1 | 5/2001 | Walker et al. | |
| 6,309,300 | B1 | 10/2001 | Glavich | |
| 6,312,334 | B1 * | 11/2001 | Yoseloff | 463/25 |
| 6,315,291 | B1 | 11/2001 | Moody | |
| 6,330,976 | B1 | 12/2001 | Dymetman et al. | |
| 6,331,143 | B1 | 12/2001 | Yoseloff | |
| 6,334,814 | B1 | 1/2002 | Adams | |
| 6,340,158 | B2 | 1/2002 | Pierce et al. | |
| 6,368,213 | B1 | 4/2002 | McNabola | |
| 6,375,568 | B1 | 4/2002 | Roffman et al. | |
| 6,379,742 | B1 | 4/2002 | Behm et al. | |
| 6,394,899 | B1 | 5/2002 | Walker et al. | |
| 6,398,214 | B1 | 6/2002 | Moteki et al. | |
| 6,398,643 | B1 | 6/2002 | Knowles et al. | |
| 6,398,644 | B1 | 6/2002 | Perrie et al. | |
| 6,398,645 | B1 | 6/2002 | Yoseloff | |
| 6,416,408 | B2 | 7/2002 | Tracy et al. | |
| 6,419,579 | B1 | 7/2002 | Bennett | |
| 6,435,408 | B1 | 8/2002 | Irwin, Jr. et al. | |
| 6,435,500 | B2 | 8/2002 | Gumina | |
| 6,478,676 | B1 * | 11/2002 | Dayan | 463/17 |
| 6,478,677 | B1 | 11/2002 | Moody | |
| 6,491,215 | B1 | 12/2002 | Irwin, Jr. et al. | |
| 6,497,408 | B1 | 12/2002 | Walker et al. | |
| 6,552,290 | B1 | 4/2003 | Lawandy | |
| 6,588,747 | B1 | 7/2003 | Seelig | |
| 6,599,186 | B1 | 7/2003 | Walker et al. | |
| 6,601,772 | B1 | 8/2003 | Rubin et al. | |
| 6,637,747 | B1 | 10/2003 | Garrod | |
| 6,648,735 | B2 | 11/2003 | Miyashita et al. | |
| 6,648,753 | B1 | 11/2003 | Tracy et al. | |
| 6,648,755 | B1 | 11/2003 | Luciano et al. | |
| 6,676,126 | B1 | 1/2004 | Walker et al. | |
| 6,692,354 | B2 | 2/2004 | Tracy et al. | |
| 6,702,047 | B2 | 3/2004 | Huber | |
| 6,773,345 | B2 | 8/2004 | Walker et al. | |
| 6,776,337 | B2 | 8/2004 | Irwin, Jr. et al. | |
| 6,786,824 | B2 | 9/2004 | Cannon | |
| 6,823,874 | B2 | 11/2004 | Lexcen | |
| 6,874,783 | B2 * | 4/2005 | Higginson | 273/269 |
| 6,875,105 | B1 | 4/2005 | Behm et al. | |
| 6,929,186 | B2 | 8/2005 | Lapstun | |
| 7,018,292 | B2 * | 3/2006 | Tracy et al. | 463/17 |
| 7,028,907 | B2 * | 4/2006 | Collins et al. | 235/470 |
| 7,104,886 | B2 * | 9/2006 | Baerlocher et al. | 463/16 |
| 7,179,167 | B2 * | 2/2007 | deKeller | 463/18 |
| 2001/0027130 | A1 | 10/2001 | Namba et al. | |
| 2001/0030978 | A1 | 10/2001 | Holloway et al. | |
| 2001/0034262 | A1 | 10/2001 | Banyai | |
| 2001/0040345 | A1 | 11/2001 | Au-Yeung | |
| 2002/0022511 | A1 | 2/2002 | Eklund et al. | |
| 2002/0084335 | A1 | 7/2002 | Ericson | |
| 2002/0171201 | A1 | 11/2002 | Au-Yeung | |
| 2002/0187825 | A1 | 12/2002 | Tracy et al. | |
| 2003/0050109 | A1 * | 3/2003 | Caro et al. | 463/17 |
| 2003/0114210 | A1 | 6/2003 | Meyer et al. | |
| 2004/0076310 | A1 | 4/2004 | Hersch et al. | |
| 2004/0173965 | A1 | 9/2004 | Stanek | |
| 2004/0178582 | A1 | 9/2004 | Garrod | |
| 2004/0185931 | A1 | 9/2004 | Hartman et al. | |
| 2004/0204222 | A1 | 10/2004 | Roberts | |
| 2004/0259631 | A1 | 12/2004 | Katz et al. | |
| 2004/0266514 | A1 | 12/2004 | Penrice | |
| 2005/0064930 | A1 * | 3/2005 | Jubinville et al. | 463/17 |

FOREIGN PATENT DOCUMENTS

| | | |
|---|---|---|
| AU | B-21070/92 | 7/1993 |
| AU | A-50327/96 | 2/1997 |
| AU | B-52499/96 | 2/1997 |
| AU | 199716432 B2 | 9/1997 |
| AU | A-45403/97 | 4/1998 |
| AU | A-63553/98 | 10/1998 |
| DE | 2938307 C2 | 4/1981 |
| DE | 3035898 A1 | 4/1982 |
| DE | 3035947 A1 | 5/1982 |
| DE | 2938307 C3 | 6/1982 |
| DE | 29803107 U1 | 8/1988 |
| DE | 3822636 A1 | 1/1990 |

| | | | |
|---|---|---|---|
| DE | 2938307 | C3 | 8/1990 |
| DE | 3822636 | A1 | 1/1992 |
| DE | 3415114 | A1 | 10/1995 |
| DE | 19646956 | C1 | 5/1998 |
| DE | 19706286 | A1 | 5/1998 |
| DE | 29816453 | U1 | 4/1999 |
| DE | 19751746 | A1 | 5/1999 |
| EP | 0122902 | B1 | 4/1984 |
| EP | 0333934 | A1 | 9/1989 |
| EP | 0458623 | | 11/1991 |
| EP | 0798676 | A1 | 10/1997 |
| EP | 0799649 | A1 | 10/1997 |
| EP | 0149712 | A2 | 7/1998 |
| EP | 0874337 | A1 | 10/1998 |
| EP | 0896304 | A2 | 2/1999 |
| EP | 0914875 | A2 | 5/1999 |
| EP | 0914875 | A3 | 5/1999 |
| EP | 0919965 | A2 | 6/1999 |
| EP | 0983801 | A2 | 3/2000 |
| EP | 0983801 | A3 | 3/2001 |
| EP | 1149712 | A1 | 10/2001 |
| ES | 529535 | | 6/1983 |
| ES | 529536 | | 6/1983 |
| ES | 2006400 | | 4/1989 |
| ES | 2006401 | | 4/1989 |
| GB | 642892 | A | 9/1950 |
| GB | 2075918 | A | 11/1981 |
| GB | 2222712 | B | 3/1990 |
| GB | 2230373 | A | 10/1990 |
| GB | 2295775 | A | 12/1996 |
| GB | 3328311 | | 2/1999 |
| GB | 23282311 | A | 2/1999 |
| JP | 02235744 | | 9/1990 |
| JP | 04132672 | | 5/1992 |
| WO | WO85/02250 | A1 | 5/1985 |
| WO | WO91/17529 | | 11/1991 |
| WO | WO 98/03910 | | 1/1998 |
| WO | WO 98/40138 | | 9/1998 |
| WO | WO 99/09364 | A1 | 2/1999 |
| WO | WO 99/26204 | | 5/1999 |
| WO | WO 99/39312 | | 8/1999 |
| WO | WO00/00256 | | 1/2000 |
| WO | WO00/78418 | A1 | 12/2000 |
| WO | WO01/74460 | A2 | 11/2001 |
| WO | WO01/93966 | A1 | 12/2001 |
| WO | WO02/056266 | A1 | 7/2002 |

OTHER PUBLICATIONS

Chip Brown, 'Austin American-Statesman', (Article), May 28, 1998, 2 Pgs., Texas.

John C. Hallyburton, Jr., 'Frequently Asked Questions About Keno', (Internet Article), 1995, 1998, 10 Pgs., (http://conielco.com/faq/keno.html).

'Horse betting Tutorial-Types of Bets'(www.homepokergames.com/horsebettingtutorial.php), (Internet Article), 2 Pgs.

Judith Gaines, 'Pool Party Betting Business Booming Throughout Area Workplaces', (Internet Article), Mar. 19, 1994. 2 Pgs., Issue 07431791, Boston Globe. Boston, MA.

'Maryland Launches Let It Ride', (Internet Article), Circa 2001, 1 Pg.

'Notice of Final Rulemaking', (Internet Article) Mar. 24, 2000, 10 Pgs., vol. 6, Issue #13, Arizona Administrative Register, Arizona.

'How To Play Megabucks', (Internet Article), Mar. 9, 2001, 2 Pgs., Oregon Lottery Megabucks,(http://www.oregonlottery.org/mega/m_howto.htm).

'How To Play Megabucks', (Internet Article), May 8, 2001, 2 Pgs., Oregon Lottery Megabucks, (http://www.oregonlottery.org/mega/m_howto.htm).

'Oregon Lottery', (Internet Article), Apr. 30, 2004, 9 Pgs., Oregon Lottery Web Center, (http://www.oregonlottery.org/general/g_hist.shtml).

'Powerball Odd & Prizes', 'How to Play Powerball', (Internet Article), Dec. 2002, 2 Pgs., (www.powerball.com/pbhowtoplay.shtm).

'Powerball Prizes and Odds', (Internet Article), 2 Pgs., http://www.powerball.com/pbprizesNOdds.shtm.

'Learn to Play the Races' (Internet Article), 15 Pgs., Racing Daily Form (www.drf.com).

Mike Parker, 'The History of Horse Racing' (Internet Article),1996, 1997,1998, 5 Pgs., http://www.mrmike.com/explore/hrhist.htm.

Horse Betting Tutorial-Types of Bets (Internet Article) (www.homepokergames.com/horsebettingtutorial.php), Aug. 7, 2004.

Powerball Prizes and Odds (Internet Article) (www.powerball.com/pbprizesNOdds), Aug. 2, 2001.

Learn to Play the Races (Internet Article), Racing Daily Form (www.drf.com), Jul. 11, 2004.

* cited by examiner

| Outcome | Inverse Probability | Prize | Return |
|---|---|---|---|
| 6 of a kind | 1,024.0 | $300 | 29.3% |
| 5 of a kind | 56.9 | $5 | 8.8% |
| 4 of a kind | 7.6 | $2 | 26.4% |
| Total | | | 64.5% |
Fig. 3
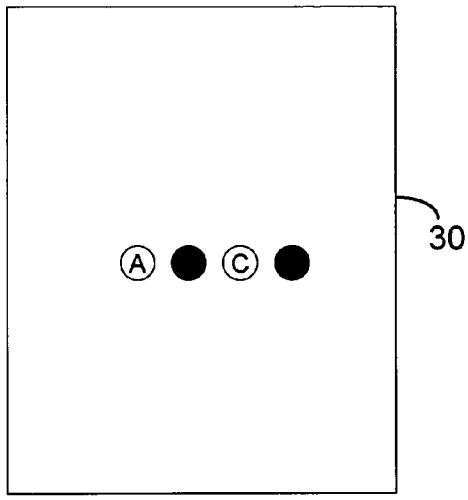
Fig. 4
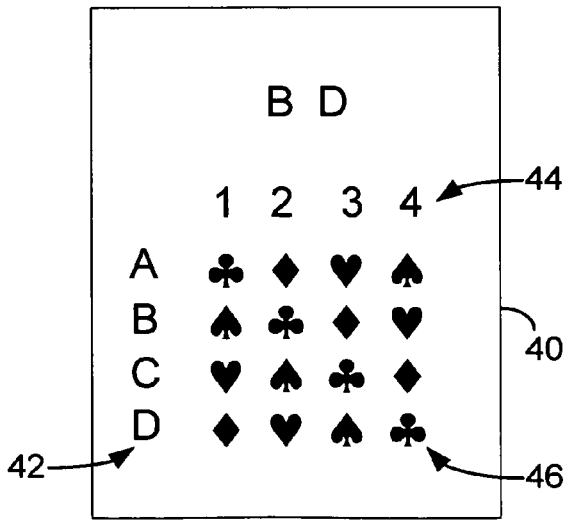
Fig. 5

| Outcome | Inverse Probability | Prize | Return |
|---|---|---|---|
| 2 Hearts | 6.0 | $3 | 50.0% |
| Total | | | 50.0% |
Fig. 6
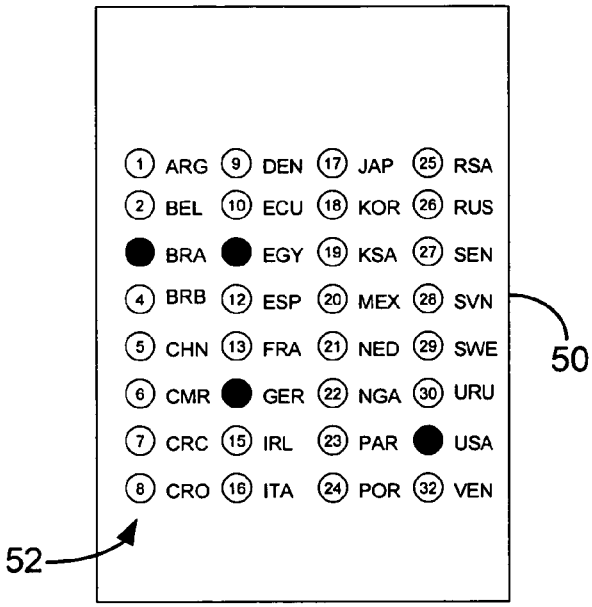
Fig. 7
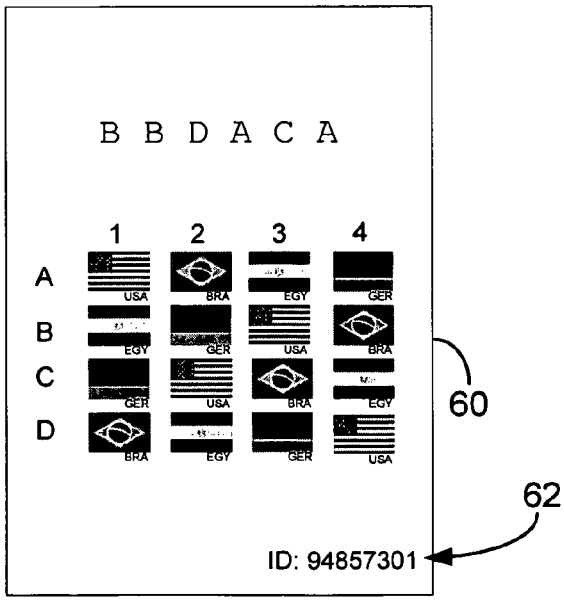
Fig. 8

| Matches | Inverse Probability | Prize | Return |
|---|---|---|---|
| 6 of a kind | 1 in 1024.0 | $500 | 24.4% |
| 5 of a kind | 1 in 56.9 | $20 | 17.6% |
| 4 of a kind | 1 in 7.6 | $4 | 26.4% |
| Total | | | 68.4% |

| ID | Win Status | Amount Won | Predominate Team |
|---|---|---|---|
| 94857301 | TRUE | 4 | BRAZIL |

| Matches | Prize |
|---|---|
| 6 | $1,000,000 |
| 5 | $2,000 |
| 4 | $50 |
| 3 | $10 |

| Outcome | Prize |
|---|---|
| 4 of a kind | dollar amount |
| 5 of a kind | 2 times dollar amount |
| 6 of a kind | 10 times dollar amount |

| Frequency | Prize | 1/Prob |
|---|---|---|
| 7 of a kind | dollar value | 21.7 |
| 8 of a kind | 3 times dollar value | 99.2 |
| 9 of a kind | 10 times dollar value | 595.5 |
| 10 of a kind | 50 times dollar value | 4,763.6 |
| 11 of a kind | 500 times dollar value | 52,399.7 |
| 12 or more of a kind | 5,000 times dollar value | 806,809.7 |

LOTTERY GAME BASED ON COMBINING PLAYER SELECTIONS WITH LOTTERY DRAWS TO SELECT OBJECTS FROM A THIRD SET OF INDICIA

CROSS-REFERENCE TO RELATED APPLICATION

This application claims the benefit of U.S. Provisional Application No. 60/617,824, filed Oct. 11, 2004, the entirety of which is hereby incorporated herein by this reference.

BACKGROUND OF THE INVENTION

1. Field of the Invention

In general, the present invention relates to systems and methods that implement lottery games. More particularly, the present invention relates to a novel on-line lottery game in which a player's game indicia and the lottery's game indicia are mapped to a third set of game indicia to determine the outcome of the game.

2. Description of the Related Art

Computerized gambling, lottery games and instant games, whether run by governmental or private entities, have proven to be quite popular. Participation in a game gives a person a chance to win a substantial amount of money while also allowing private parties and lottery authorities to collect monies, some of them for public or charitable purposes. When taxed, the sales from games also provide additional revenue to state and city governments.

As lotteries have become ubiquitous it has become a challenge to sustain interest and profitability. One approach to this challenge is to expand game content. As known, a typical lottery game correlates a player's game indicia to the lottery's game indicia to determine the number of "matches" for determining game winners. This paradigm has become stagnant. New games are needed to rekindle player interest, in particular, games that facilitate a transition to higher prices. Such games at higher prices should be more substantial as to justify the higher cost. However, the need for substance must be counterbalanced against overly increasing game complexity and player confusion, which could actually cause player disinterest. Thus, lottery games are sought that are more engaging, involving, and, thus, entertaining, and yet remain broadly accessible. It is thus to such a game that the present invention is primarily directed.

SUMMARY OF THE INVENTION

In the inventive lottery game, two sets of indicia are correlated. This correlation is then mapped to a third set of game indicia, the "outcome," upon which prizes are based.

In one embodiment, the lottery game method includes the steps of a game player selecting a wager amount for a game, providing the player a first set, second set and third set of game objects. Then the method continues with determining a first sequence from the first set of objects, determining a second sequence from the second set of objects; correlating the first and second sequences; and mapping the correlation to a third sequence from the third set of objects. Then the method concludes with awarding prizes based on the third sequence of objects.

In other embodiments, this invention is integrated with other lottery games, such as raffles and permutation games, to allow for higher price points and to enrich the player experience.

Other objects, advantages, and features of the invention will become apparent after the hereinafter set forth Brief Description of the Drawings, Detailed Description of the Invention, and Claims appended herewith.

BRIEF DESCRIPTION OF THE DRAWINGS

FIG. 3 is an illustration of a first embodiment of a prize table for use with the lottery game.

FIG. 4 is an illustration of a second embodiment of a lottery game playslip bearing exemplary player selections thereon.

FIG. 5 is an illustration of a second embodiment of a lottery game ticket correlating to the playslip selections of FIG. 4.

FIG. 6 is an illustration of a second embodiment of a prize table for use with the lottery game.

FIG. 7 is an illustration of a third embodiment of a lottery game playslip bearing exemplary player selections thereon.

FIG. 8 is an illustration of a third embodiment of a lottery game ticket correlating to the playslip selections of FIG. 7.

DETAILED DESCRIPTION OF THE INVENTION

In a preferred embodiment, the invention comprises a system and method of implementing a lottery game having the following components: (1) three finite sets of objects: $S_1$, $S_2$, $S_3$, (2) a sequence of objects from $S_1$, (3) a sequence of objects from $S_2$, (4) a process or rule that correlates these sequences, and (5) a process or function that maps this correlation into $S_3$.

The general scenario is that there exist three finite sets of objects known to the player. A $1^{st}$ sequence from a first set of objects $S_1$ is produced by the player selecting the sequence, the lottery selecting the sequence, or a combination of both. A $2^{nd}$ sequence from a second set of objects $S_2$ is produced by the player selecting the sequence, the lottery selecting the sequence, or a combination of both. A ticket is issued memorializing the player's selections and none, some, or all of the lottery's selections, depending on the embodiment. Once determined, the $1^{st}$ sequence (from $S_1$) and the $2^{nd}$ sequence (from $S_2$) are correlated. An example of a correlation would be that each term in the 1st sequence is identified with the term in the same relative position in the $2^{nd}$ sequence. For example, if $a_1a_2 \ldots a_n$ is the sequence in $S_1$ and $b_1b_2 \ldots b_n$ is the sequence in $S_2$ the resulting correlation could be the set of ordered pairs: $(a_1, b_1)$ $(a_2, b_2)$ . . . $(a_n, b_n)$.

There is a process or a function that maps the correlation of the two sequences to a third set of objects, $S_3$. This function may be general knowledge or it may be disclosed to the player on his ticket and vary per play. The function may be defined by a matrix displayed on the ticket for which the entries are elements of the third set $S_3$, and where each element in $S_1$ is identified with a row and each element in $S_2$ is identified with a column. The matrix assigns an ordered pair (a, b) the entry in row a and column b. For example, the matrix may be a "Latin square," for which each row and column have exactly one occurrence of each element of $S_3$. This function (e.g. matrix) maps the correlation of the $1^{st}$ and $2^{nd}$ sequence, (e.g. a set of ordered pairs) to a sequence in $S_3$, This sequence is the "outcome" on which prizes are based. Prizes may be based on which and how many times elements from $S_3$ occur in the outcome. Prizes could also be determined by the order in which objects appear in the outcome.

Figure 1:
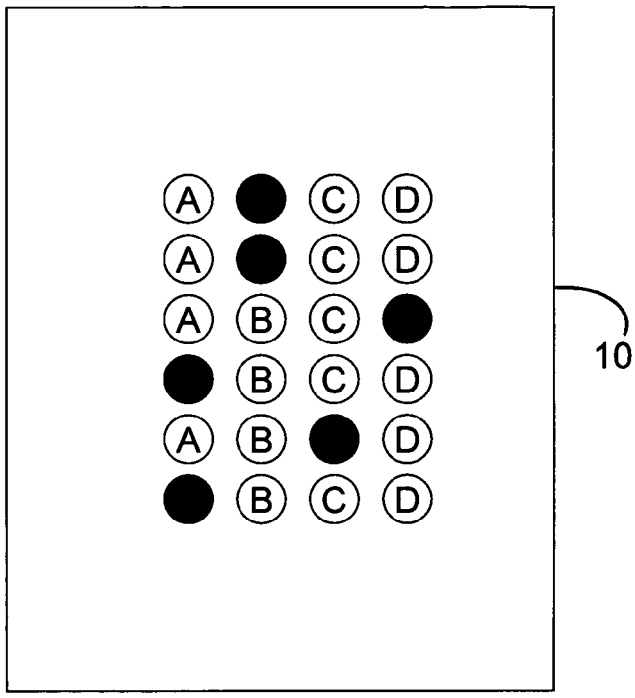
FIG. 1 is an illustration of a first embodiment of a lottery game playslip bearing exemplary player selections thereon.
Figure 2:
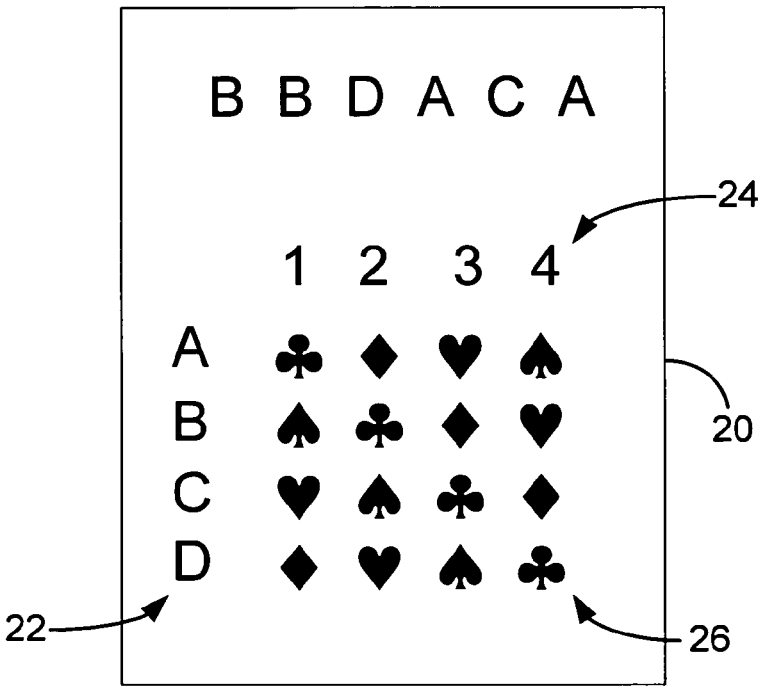
FIG. 2 is an illustration of a first embodiment of a lottery game ticket correlating to the playslip selections of FIG. 1.

A basic embodiment is described based on sets $S_1$={A, B, C, D}, $S_2$={1, 2, 3, 4}, and $S_3$={♣♦, ♥, ♠}. A player indicates a sequence from $S_1$ by use of a playslip 10 in FIG. 1. (Alternatively, the lottery randomly selects the sequence for him.) The sequence that the player selected is B-B-D-A-C-A. The player pays $1, submits his playslip 10 to a retailer, and receives a ticket 20 indicating his selection as illustrated in FIG. 2. Also, indicated on the ticket is a matrix (26) whose entries are elements of $S_3$ and such that each element of $S_1$ is identified with a row (22) and each element of $S_2$ is identified with a column (24). Moreover, this matrix is a Latin square, meaning there is exactly one of each element of $S_3$ in each row and column. The lottery organization then randomly selects a sequence of objects from $S_2$. For this example, assume the lottery selected the sequence 2-4-4-1-2-1. The rule by which the player's selection of letters and the lottery's selection of digits are correlated is that the terms in the player's sequence are paired with the corresponding terms in the lottery's draw to get the sequence of ordered pairs (B, 2) (B, 4) (D, 4) (A, 1) (C, 2) (A, 1).

The matrix assigns each of these ordered pairs the element in $S_3$ referenced by that ordered pair. For example, the matrix assigns (B, 2) the object in row B-column 2, which is ♣. (The matrix in this example is a "Latin Square") The resulting sequence in $S_3$ is ♣♥♣♣♣♣ the "outcome." Prizes are awarded based on the prize table in FIG. 3. The prize table indicates outcomes for which prizes are awarded, along with the corresponding inverse probabilities, and the returns based on a $1 wager (both the returns for the individual outcomes and the total return for the game). Those skilled in the art of Mathematics can verify this table. The prize for 4 of a kind is $2. As there are four ♣'s in the outcome, the player wins the prize for 4 of a kind, which is $2.

In another embodiment, let $S_1$={A, B, C, D}, $S_2$={1, 2, 3, 4}, and $S_3$=♣♦, ♥, ♠as in the above embodiment. The player chooses two distinct elements from $S_1$ using a playslip 30 as illustrated in FIG. 4. The player has selected the combination B-D. The "sequence" is understood to be the combination in alphabetical order. The player pays $1, submits their playslip to a retailer and receives a ticket 40 as illustrated in FIG. 5. The ticket displays the player's selection. The lottery draws two distinct elements from $S_2$, say 3-4. The "sequence" from $S_2$ is the lottery's draw in numerical order. The rule by which the player's letters and the lottery's numbers are correlated is by taking the cross product of the terms, i.e. all ordered pairs, such that the first coordinate is either B or D and the second coordinate is either 3 or 4: (B, 3) (B, 4) (D, 3) (D, 4). The cross product is ordered by the "dictionary" order. There is also a matrix on the ticket that maps this sequence of ordered pairs to a sequence in $S_3$. The outcome produced by mapping the sequence (B, 3) (B, 4) (D, 3) (D, 4) into $S_3$ by f is ♦ ♥ ♣♣. The prize table based on a $1 wager is illustrated in FIG. 6. The player wins if and only if their outcome contains two ♥'s for which there is a 1 in 6 probability. As the outcome contains only one ♥, the player does not win.

The current invention can be combined with other lottery games to enhance the play value. In one embodiment, this invention is integrated with a raffle game. This embodiment coincides with a sports tournament in which there are thirty-two teams competing over several weeks, for example, as is done in the World Cup Soccer tournament held every four years. We let $S_1$={A, B, C, D}, $S_2$={1, 2, 3, 4}, as in previously discussed embodiments. However, in this embodiment the player can choose the elements of $S_3$ (elements 52). The player uses a playslip 50 as in FIG. 7 to pick four out of thirty-two teams, and has selected Brazil, Egypt, Germany, and USA. These four teams comprise $S_3$. The player pays $2, submits their playslip and receives a ticket 60 as in FIG. 8. On this ticket, a sequence of six terms from $S_1$ has randomly been assigned to him, in this case, B B D A C A. Also displayed on the ticket is an ID number 62 unique to that ticket 60. The lottery conducts a draw for this game and produces 4-3-1-2-3-3. A draw is conducted every day of the tournament. The rule by which the player's selection and the lottery's draw are correlated is that each term is the player's letters paired with the corresponding number in the lottery's draw: (B, 4)(B,3)(D,1)(A,2)(C,3)(A,3). Also displayed on the ticket is a grid of flags representing the teams the player selected. (The grid is a Latin square.)

Figures 9, 10, 11:
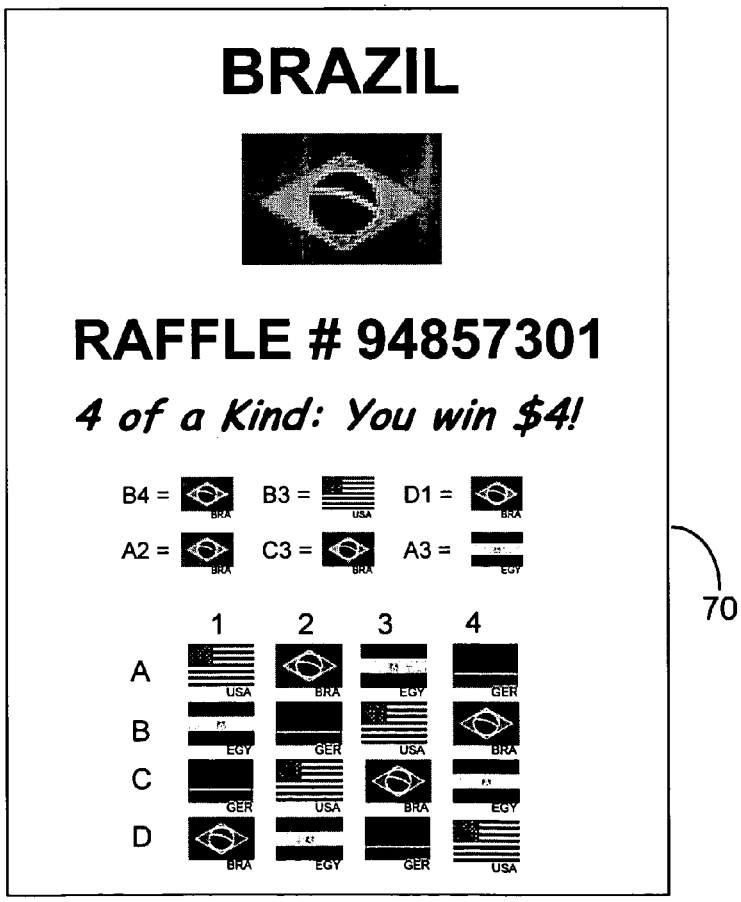
FIG. 9 is an illustration of a third embodiment of a prize table for use with the lottery game.
FIG. 10 is an illustrative embodiment of a database entry for a lottery game ticket.
FIG. 11 is an illustrative embodiment of a trailer lottery game ticket.

As the rows on the square are indexed by A, B, C, and D and the columns are indexed by 1, 2, 3, and 4, the grid maps the sequence (B, 4)(B,3)(D,1)(A,2)(C,3)(A,3) to BRAZIL USA BRAZIL BRAZIL BRAZIL EGYPT. This is the outcome. The prize table is indicated in FIG. 9 and is based on a $2 wager. The player thus has won $4 for 4 of a Kind. In addition to this prize, the player may be eligible for a raffle, depending on the outcome of the tournament. If the player wins, it is necessarily the case that there is a predominate element of $S_3$ in the outcome, in this case it is BRAZIL. The lottery has on record in a database the ticket's identification number, the fact that the ticket has won, and the predominate country, as illustrated in FIG. 10. Also, for the players' convenience, he may receive a trailer ticket 70 as illustrated in FIG. 11 indicating their winnings, the predominate team, and a raffle number, which is the same as the identification number.

At the end of the tournament all tickets whose predominate team placed in the tournament are entered into the raffle. More precisely, the lottery filters out all records for winning tickets for which the predominate team placed $1^{st}$, $2^{nd}$, or $3^{rd}$. These records are entered into a raffle in which one or more prizes are awarded. Either physical tickets are produced or the raffle is conducted electronically as with a random number generator. The fact that the player was able to select the four teams represented on their ticket (i.e. $S_3$) involved strategy: the more likely one of their teams were to place in the tournament, the more likely he will be included in the raffle.

Figure 12:
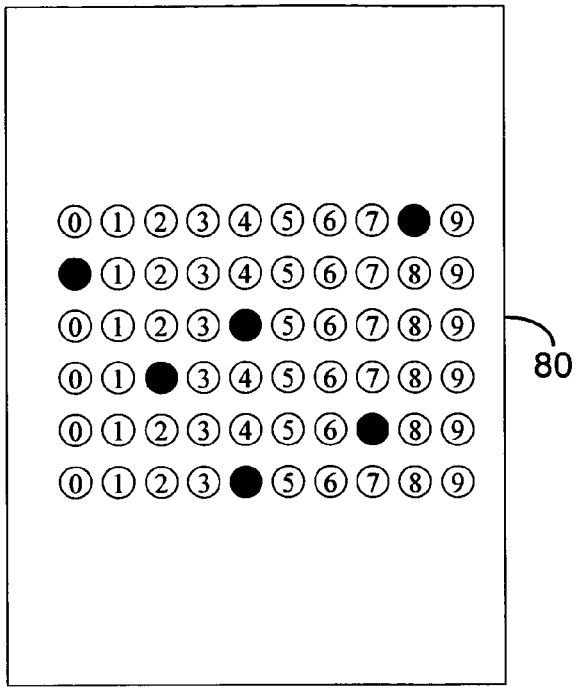
FIG. 12 is an illustration of a fourth embodiment of a lottery game playslip bearing exemplary player selections thereon.
Figure 13:
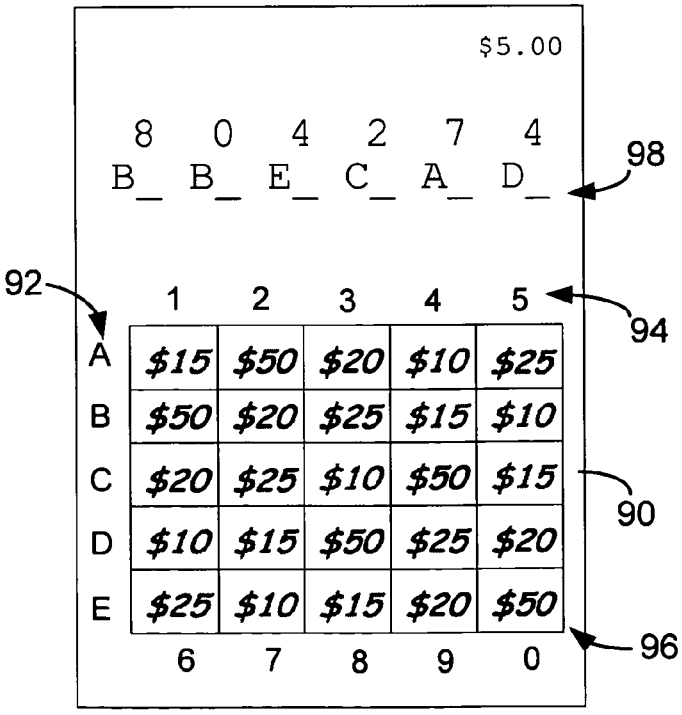
FIG. 13 is an illustration of a fourth embodiment of a lottery game ticket correlating to the playslip selections of FIG. 12.
Figures 14, 15, 16:
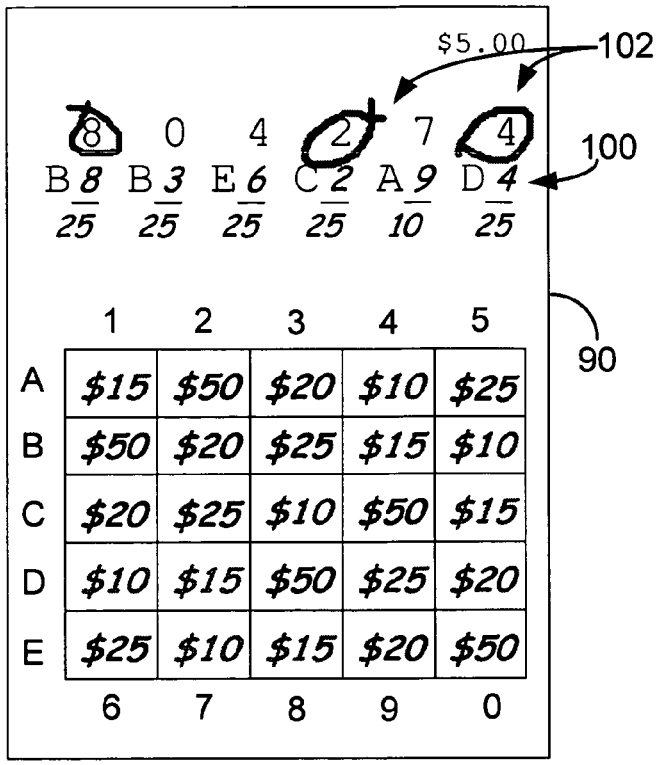
FIG. 14 is an illustration of the lottery game ticket of FIG. 13 bearing player markings thereon.
FIG. 15 is an illustration of a fourth embodiment of a prize table for use with the lottery game.
FIG. 16 is an illustration of a fifth embodiment of a prize table for use with the lottery game.

Another example of this invention is incorporated with a digits game shown in FIGS. 12-14. For this embodiment, $S_1$={A, B, C, D, E}, $S_2$={0, 1, 2, 3, 4, 5, 6, 7, 8, 9}, and $S_3$={$10, $15, $20, $25, $50}. A player selects 6 digits, each ranging from 0 to 9, using a playslip 80 as shown in FIG. 12. The player pays $5, submits a playslip 80, and receives a ticket 90 as illustrated in FIG. 13. The ticket displays the digits he selected: 8 0 4 2 7 4. For each digit the player selected, a letter is randomly selected from $S_1$ and displayed under it one space to the left. These letters comprise a sequence in $S_1$. There is also a 5 by 5 grid on the ticket, the entries comprising elements of $S_3$. The rows are indexed by A, B, C, D, and E, the elements of $S_1$. Each element in $S_2$ is identified with a column as the columns are labeled 1, 2, 3, 4, and 5 on the top and 6, 7, 8, 9, 0 on the bottom. (Note, there is not a one-to-one correspondence between $S_2$ and the number of columns, that is not required.)

At a scheduled time, such as a daily event, the lottery draws a sequence of six terms from $S_2$. For this example, suppose the sequence is 8 3 6 2 9 4. On the ticket 90 in FIG. 13, there is a underlined space 98 beside each letter and beneath each of the player's selected digits. These are provided so that the player may write the drawn digits thereon. In FIG. 14, the player has written the drawn sequence (drawn digits 100) in the provided underlined spaces. The player then proceeds as follows: The player circles the matches (circles 102) between their selected digits and those chosen by the lottery. In this case, the player has matched digits 8, 2, and 4 in positions 1, 4, and 6. He scores 3 matches. Next, the player combines each of their letters with the corresponding drawn digit to determine a dollar value as determined by the grid. The sequence B8 B3 E6 C2 A9 D4 maps to the outcome: $25 $25 $25 $25 $10 $25.

Prizes are as described in the prize tables in FIGS. 15 and 16. In this example, the player matched 3 of their digits with those drawn by the lottery, he wins $10 as indicated in FIG. 15. Also, as the outcome from the grid contained 5 occurrences of $25, the player wins that dollar value multiplied by 2=$50, as described in FIG. 16. The player takes the total from these two prize tables: $60. Those skilled in the art of Mathematics can verify that the return to the player is 72.1% based on a $5 wager.

Figure 18:
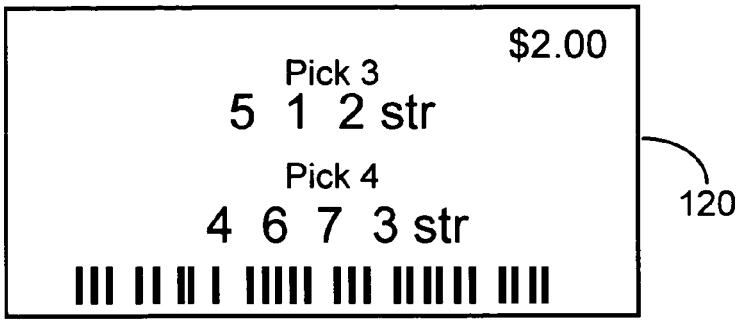
FIG. 18 is an illustrative embodiment of a ticket for a permutation-based lottery game.
Figure 19:
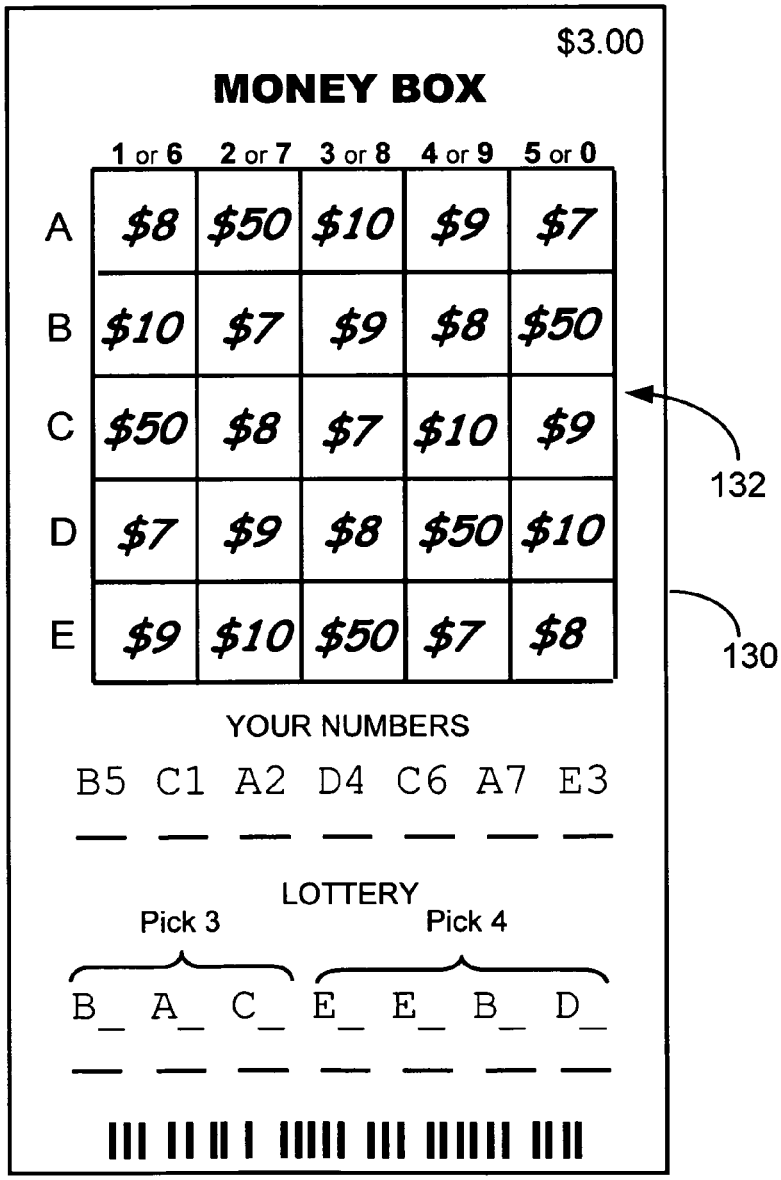
FIG. 19 is an illustration of a lottery game ticket for the lottery game of FIG. 18.

Popular throughout lotteries are 3-digit and 4-digit permutation games. In one embodiment, this invention provides an extension game to existing digit games. For $5, a player receives a $1 3-digit game, a $1 4-digit game and a $3 extension game based on the current invention. The player places a $1 3-digit bet and $1 4-digit bet, which is memorialized on a ticket 120 as in FIG. 18. (The particular bet type, e.g. straight or box, does not matter, only that there is a $1 wager on each digit game.) He receives an additional game on a based on the current invention as the ticket 130 in FIG. 19.

The additional game displays a 5 by 5 matrix 132 for which the rows are identified with letters A through E and for which the first column is identified with digits 1 and 6, second column is identified with digits 2 and 7, the third column is identified with digits 3 and 8, the fourth column is identified with digits 4 and 9, and the fifth column is identified with digits 5 and 0. The matrix is a Latin square based on the dollar values $7, $8, $9, $10, and $50. From ticket to ticket, the Latin square may be constant or random. (That is, given 5 symbols, a 5 by 5 Latin square can be chosen uniformly from the set of all possible Latin squares.)

Figures 20, 21:
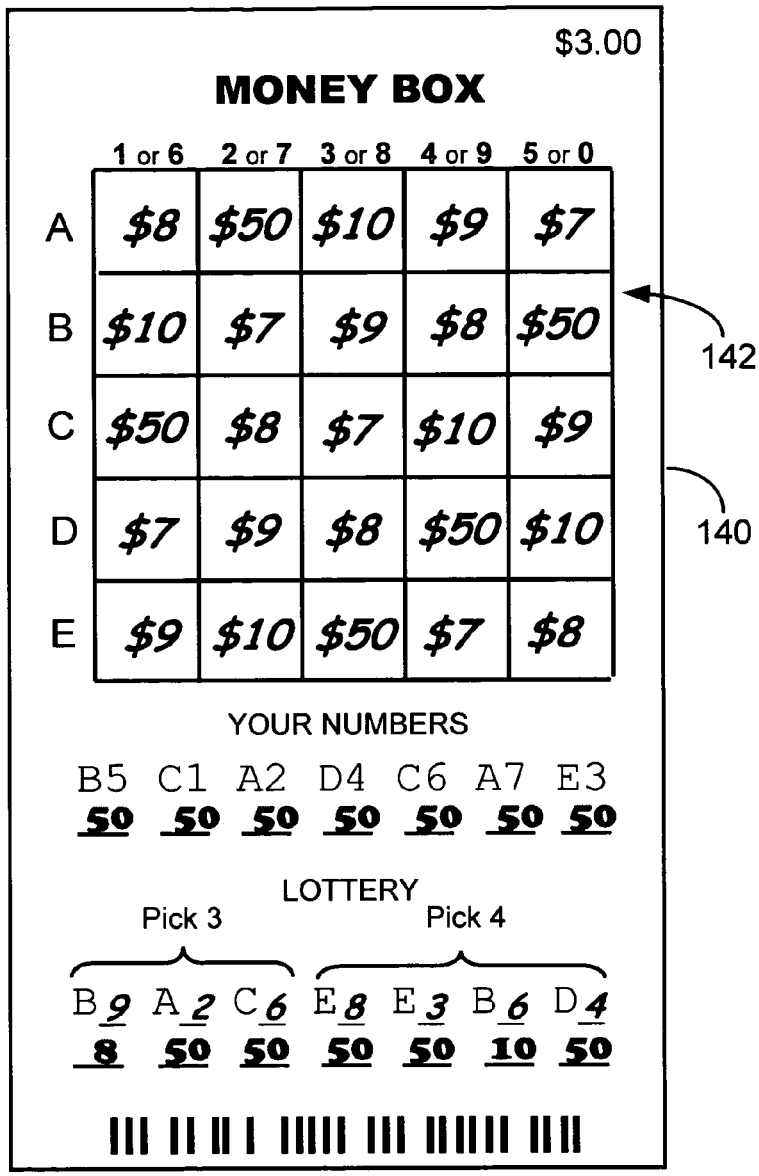
FIG. 20 is an illustration of the lottery game ticket of FIG. 19 bearing player markings thereon.
FIG. 21 is an illustration of a sixth embodiment of a prize table for use with the lottery game.

Displayed on the ticket 130 are the player's 7 digits from the 3-digit and 4-digit games, each randomly paired with one of the letters A through E. Also, displayed is a random sequence of 7 letters from the set {A, B, C, D, E} not yet paired with digits. The lottery conducts the 3 digit and 4 digit draws at the scheduled time determining whether or not and how much he wins in the 3-digit and 4-digit games. For the additional inventive game, the player pairs each of the unpaired 7 letters on the ticket with the corresponding digits from the draw. Suppose the lottery's draw is 926 for the 3-digit game and 8364 for the 4 digit. As indicated in FIG. 20, the player marks each of these 7 digits in the space by the corresponding letter. There are now has 14 letter-digit pairs on the ticket 140: 7 of them produced by pairing the player's 7 digits with randomly selected letters and the other 7 by pairing the lottery's 7 drawn digits with randomly selected letters. By identifying a letter with a row and a digit with a column in the matrix 142, each of the letter-digit pairs is identified with a dollar value. (For example, the pair B6 would be identified with $10, as B6 refers to the second row, first column, occupied by a $10 symbol.) For each of the 14 letter-digit pairs, the player records the identified dollar value. In FIG. 20, the 14 letter-digit pairs are B5, C1, A2, D4, C6, A7, E3, B9, A2, C6, E8, E3, B6, D4. The corresponding dollar values are $50, $50, $50, $50, $50, $50, $50, $8, $50, $50, $50, $50, $10, $50. The player counts the occurrences of the dollar values: twelve 50's, one 10, and one 8. Prizes are based on the number of occurrences of a dollar value. A prize is either the dollar value or a multiplier thereof, as indicated in FIG. 21: In this example, $50 occurs 12 times and the player is awarded $50 multiplied by 5,000, which is $250,000. One skilled in the art of Mathematics can verify the inverse probabilities in FIG. 21 and that the overall return for the $3 additional game (i.e. excluding the 3-digit and 4-digit game) is 66.8%. (Note: in computing the probabilities for any letter-digit pair, each of the 5 dollar values is equally likely. Furthermore, each letter-digit pair is independent.)

Note in the previous embodiment, the $1^{st}$ sequence is B, C, A, D, C, A, E, B, A, C, E, E, B, D form the first set $S_1$={A, B, C, D, E} and the $2^{nd}$ sequence is 5, 1, 2, 4, 6, 7, 3, 9, 2, 6, 8, 3, 6, 4 from the second set $S_2$=0, 1, 2, 3, 4, 5, 6, 7, 8, 9, 0}. The sequence of letters in $S_1$ that comprised the row positions for the ordered pairs was assigned to the player by the lottery. The sequence of digits in $S_2$ was chosen by both the player and the lottery (the first 7 by the player and the $2^{nd}$ 7 by the lottery). In the current invention, depending on the embodiment, one, the other, or both the player and the lottery may participate in choosing the sequences in $S_1$ and $S_2$.

Figure 17:
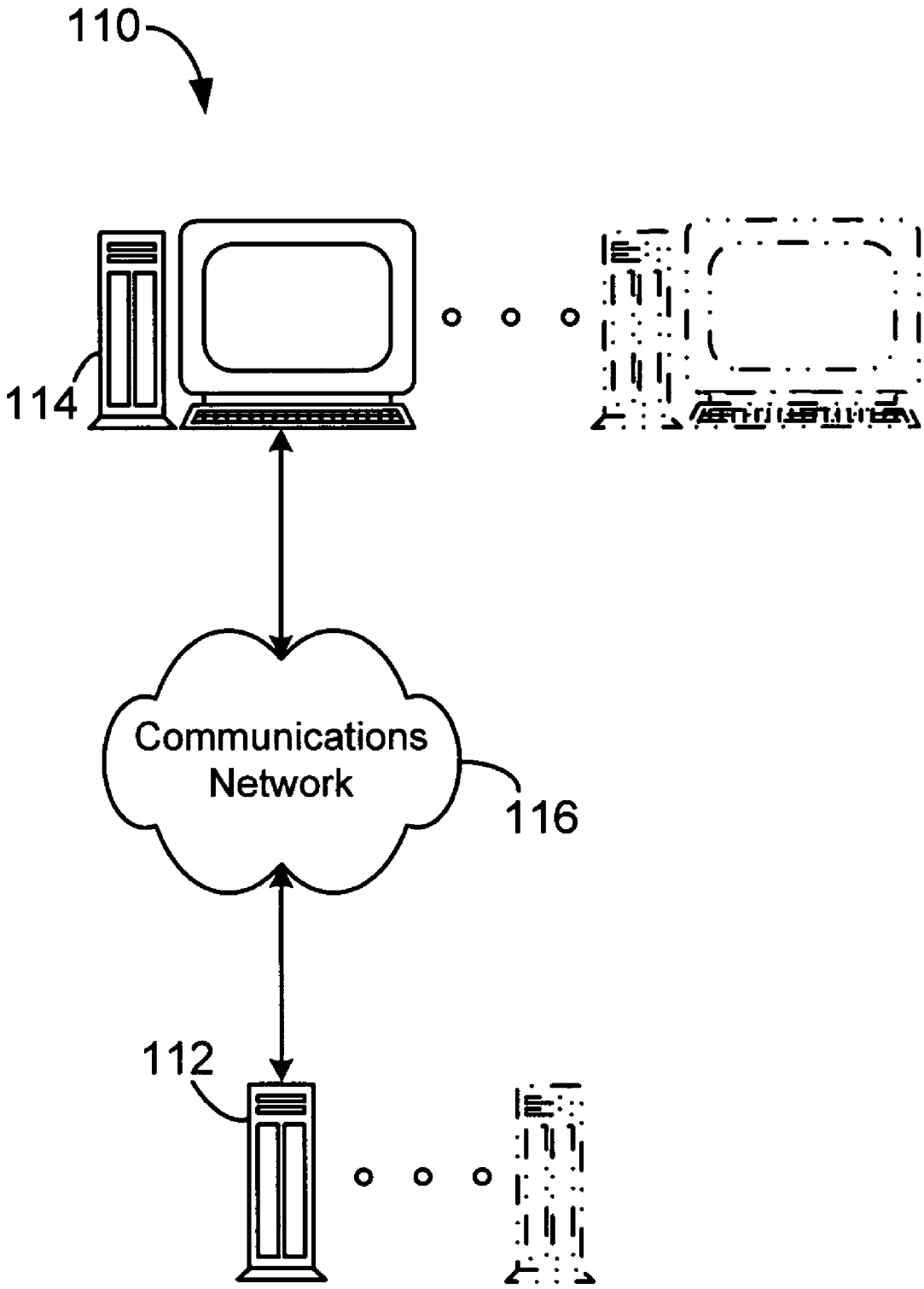
FIG. 17 is a diagram of one embodiment of the system to implement the inventive lottery gaming method.

FIG. 17 is a diagram of one embodiment of the system 110 to implement the inventive lottery gaming method across a network 116. The system 110 includes at least one game terminal 114 that allows a game player to enter one or more rounds of a lottery game, the terminal 114 further allowing the player to select a wager amount and enter a round of game play. At least one gaming server 112 provides to the at least one game terminal 114 a first set (Column 22 in FIG. 2), second set (Row 24) and third set (Grid 26) of game objects, wherein a first sequence from the first set of objects is determined by (or assigned to) the player, with the server 112 further drawing a second sequence from the second set of objects. Then the server 112 correlates the first sequence of objects and the second sequence of objects and maps the correlation to a third sequence in the third set of game objects and awarding prizes based on the third sequence of objects.

The foregoing descriptions present only exemplary embodiments. Those of ordinary skill in the art will readily recognize that the invention may be applied to a wide range of sports tournament structures and that even within a given tournament structure many variations are possible by adjusting the assignment of points to participants, for example by awarding more points for matches won in the later rounds of the tournament. Moreover, the invention may be applied to any reality-based event, sporting or otherwise, that results in the partition of a plurality of participants into a plurality of categories, where the plurality of participants within each category is known in advance. These applications and variations thereof are contemplated as being within the scope of the present invention.

While there has been shown a preferred and alternate embodiments of the present invention, it is to be understood that changes can be made in the form and numbering of the elements without departing from the underlying scope of the invention as set forth in the claims. Further, elements are assumed to include the plural unless otherwise explicitly defined.

What is claimed is:

1. A lottery game method, comprising the steps of:

a game player selecting a wager amount for a game;

providing a first set, second set and third set of pre-determined game objects, wherein each of the first set, second set, and third set of game objects are different and independent from the other two respective sets of game objects and not limited or defined by any action taken by the game player with respect to the other two sets of game objects;

generating a first sequence of objects from the first set of objects;

generating a second sequence of objects from the second set of objects;

correlating the first and second sequences such that each game object in the first sequence is associated in an ordered pair with a respective game object in the second sequence of game objects as a function of the relative order of the objects in the first and second sequences of objects;

mapping the ordered pairs of the first sequence of objects and the second sequence of objects to a randomly generated sequence of the third set of objects such that each ordered pair of objects identifies a respective object from the third set of game objects to define a final set of game objects; and awarding prizes based on the final set of game objects.

2. The method of claim 1, wherein the step of mapping the ordered pairs of the first sequence of objects and the second sequence of objects further comprises defining a random matrix from the third set of game objects wherein each of the elements in the first sequence of objects in the ordered pairs is identified with a row and each of the elements in the second sequence of objects in the ordered pairs is identified with a column of the matrix such that the final set of game objects are identified by their position in the matrix corresponding to the ordered pairs.

3. The method of claim 1, wherein the step of mapping the first sequence of objects and the second sequence of objects further comprises identifying each term in the first sequence with the term in the second sequence in the same relative position within each sequence.

4. The method of claim 1, wherein the step of mapping the first sequence of objects and the second sequence of objects further comprises a cross product of the terms in the respective sequences.

5. The method of claim 1, further comprising the step of memorializing the player's selections and the process by which the said correlation of the first and second sequences are mapped to a third set of objects on a ticket.

6. The method of claim 5 further comprising the step of memorializing at least one lottery selected indicium on the ticket.

7. The method of claim 1, further comprising the step of awarding prizes based on the frequency with which certain objects of the third set of objects occur in the mapping.

8. The method of claim 1, wherein the inventive game is combined with another lottery game, and at least one indicium of the draw sequence from the other game comprises at least one term of the said second sequence of objects in the inventive game.

9. The method of claim 1, wherein the player is entered into a second game comprising a raffle based upon the outcome of the inventive game.

10. The method of claim 1, wherein the lottery game is combined with another game, and at least one indicium of the draw sequence from the other game comprises at least one term of the said second sequence of objects in the inventive game.

11. The method of claim 8, wherein the player of the first and second games is awarded a sum of prizes from the two games.

12. The method of claim 8, wherein the player of the first and second games is awarded the maximum of the prizes from the first game and the prizes from the second game.

13. The method of claim 8, wherein the second game comprises a number selection game.

14. A system for implementing a lottery game to one or more players, comprising:

at least one game terminal that allows a game player to enter one or more rounds of a lottery game, the terminal further allowing the player to select a wager amount and enter a round of game play; and at least one gaming server that provides to the at least one game terminal a first set, second set and third set of pre-determined game objects wherein each of the first set, second set, and third set of game objects are different and independent from the other two respective sets of game objects and not limited or defined by any action taken by a game player with respect to the other two sets of game objects, and wherein a first sequence of objects is generated from the first set of objects, the server further generating a second sequence of objects from the second set of objects, correlating the two sequences such that each object from the first sequence of game objects is associated in an ordered pair with a respective object from the second sequence of game objects as a function of the relative order of the objects in the first and second sequences of objects, then the server mapping the ordered pairs to a randomly generated sequence of the third set of game objects such that each ordered pair identifies a respective object from the third set of game objects to define a final set of game objects, and awarding prizes based on the final set of game objects.

15. The system of claim 14, wherein the server generates a random matrix of the third set of game objects and maps the ordered pairs to the matrix wherein each of the elements in the first sequence of objects in the ordered pairs is identified with a row and each of the elements in the second sequence of objects in the ordered pairs is identified with a column such that the final set of game objects are identified by their position in the matrix corresponding to the ordered pairs.

16. The system of claim 14, wherein the server further identifying each term in the first sequence with the second term in the second sequence in the same relative position in the sequence.

17. The system of claim 14, wherein the server combines the inventive game with another lottery game, and at least one indicium of the draw sequence from the other game comprises at least one term of the said second sequence of objects in the inventive game.

18. The system of claim 17, wherein the player of the first and second games is awarded a sum of prizes from the two games.

19. The system of claim 17, wherein the player of the first and second games is awarded the maximum of the prizes from the two games.

20. A system for implementing a lottery game to one or more players, comprising:

a gaming means for allowing a game player to enter one or more rounds of a lottery game, the gaming means further allowing the player to select a wager amount and enter a round of game play; and a game controller means for providing to the gaming means a first set, second set and third set of pre-determined game objects wherein each of the first set, second set, and third set of game objects are different from the other two respective sets of game objects and not limited or defined by any action taken by the game player with respect to the other two sets of game objects, and wherein a first sequence of objects is generated from the first set of objects, the game controller means further generating a second sequence of objects from the second set of objects, then the game controller means further correlating the first sequence of objects and the second sequence of objects such that each object from the first sequence of game objects is associated in an ordered pair with a respective object from the second sequence of game objects as a function of the relative order of the objects in the first and second sequences of objects and mapping the ordered pairs to a randomly generated sequence of the third set of game objects such that each ordered pair of objects from the first and second sequences of game objects identifies a respective object from the third set of game objects to define a final set of game objects, and awarding prizes based on the final set of game objects.

21. The method of claim 1, wherein the player selects the sequence of the first set of game objects.

22. The method of claim 21, wherein the player selects the sequence of the second set of game objects.

23. The method of claim 21, wherein the sequence of the second set of game objects is randomly generated for the player.

24. The system of claim 14, wherein the game terminal is configured to allow the player to select the sequence of the first set of game objects, and the sequence of the third set of game objects is randomly generated by the gaming server.

25. The system of claim 24, wherein the player further selects the sequence of the second set of game objects at the game terminal.

26. The system of claim 24, wherein the sequence of the second set of game objects is randomly generated for the player by the gaming server.

* * * * *